US012642359B2

(12) United States Patent
Wang et al.

(10) Patent No.: US 12,642,359 B2
(45) Date of Patent: Jun. 2, 2026

(54) FOLDING SOFA BED WITH LEG REST

(71) Applicant: A&C FUTURE, INC., Newport Beach, CA (US)

(72) Inventors: Jiuqi Wang, Santa Ana, CA (US); Shoue Chen, Irvine, CA (US); Qiyin Pan, Irvine, CA (US); Ju Gao, Newport Beach, CA (US); Han Qin, Newport Beach, CA (US); Jiayang Qin, Newport Beach, CA (US)

(73) Assignee: A&C FUTURE, INC., Irvine, CA (US)

( * ) Notice: Subject to any disclaimer, the term of this patent is extended or adjusted under 35 U.S.C. 154(b) by 138 days.

(21) Appl. No.: 18/457,253

(22) Filed: Aug. 28, 2023

(65) Prior Publication Data

US 2025/0072622 A1 Mar. 6, 2025

(51) Int. Cl.

| | |
|---|---|
| ***A47C 17/175*** | (2006.01) |
| ***A47C 17/48*** | (2006.01) |
| ***A47C 17/86*** | (2006.01) |
| ***A47C 20/10*** | (2006.01) |

(52) U.S. Cl.

CPC ..... *A47C 17/1753* (2013.01); *A47C 17/48* (2013.01); *A47C 17/86* (2013.01); *A47C 20/10* (2013.01)

(58) Field of Classification Search

CPC ..... A47C 17/00; A47C 17/1753; A47C 17/48; A47C 17/86; A47C 20/10; A47C 17/16; A47C 17/40

See application file for complete search history.

(56) References Cited

U.S. PATENT DOCUMENTS

| | | | | |
|---|---|---|---|---|
| 4,039,968 | A * | 8/1977 | Emshwiller | H03L 7/20 331/61 |
| 4,512,048 | A * | 4/1985 | Isham | A47C 17/80 297/65 |
| 4,631,763 | A * | 12/1986 | Singer | A47C 17/48 5/159.1 |
| 5,280,636 | A * | 1/1994 | Kelley | H04B 1/66 455/190.1 |
| 6,163,900 | A * | 12/2000 | Stevenson | A47C 17/80 5/118 |
| 7,793,366 | B2 * | 9/2010 | Stoltzfus | A47C 17/40 5/907 |
| 7,802,329 | B1 | 9/2010 | Shrock et al. | |
| 8,186,744 | B1 | 5/2012 | Hanser et al. | |
| 2003/0121099 | A1 | 7/2003 | Lim et al. | |

(Continued)

*Primary Examiner* — Fredrick C Conley
(74) *Attorney, Agent, or Firm* — INNOVATION CAPITAL LAW GROUP, LLP; Vic Lin

(57) ABSTRACT

A sofa bed can solve the problem of where to place a sofa in a smaller space or inside a recreational vehicle. The sofa can be completely flattened out to become a sofa bed. When not needed or when space is limited, the sofa bed can be folded directly against the wall. The sofa bed can include a back support cushion, a seat cushion and a leg rest. The back support and seat cushions can be supported by a frame underneath. A system of spring-loaded rods can be under the leg rest. These parts can be completely flattened or turned into a sofa, with the leg rests covering the frame underneath the sofa. The sofa can be folded to the wall, controlled by hydraulic rods at the bottom. The legs of the sofa bed and the hydraulic rods can be designed to not protrude from the wall when folded.

19 Claims, 13 Drawing Sheets

(56) References Cited

U.S. PATENT DOCUMENTS

| | | | | |
|---|---|---|---|---|
| 2020/0196768 | A1 | 6/2020 | Wesolowski et al. | |
| 2020/0305612 | A1 | 10/2020 | Dimitrov | |
| 2023/0011830 | A1 | 1/2023 | Natuzzi | |
| 2023/0133923 | A1 | 5/2023 | Spurgin | |
| 2025/0302204 | A1* | 10/2025 | Pan ..... | A47C 17/17 |

* cited by examiner

FOLDING SOFA BED WITH LEG REST

BACKGROUND OF THE INVENTION

1. Field of the Invention

Embodiments of the invention relate generally to furniture construction and storage. More particularly, embodiments of the invention relate to a sofa bed that can be folded and stored against a wall.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Storage space within a home can be limited, especially in smaller homes, mobile homes, recreational vehicles or foldable homes. Some furniture items may be useful only during certain times of the day (such as a bed or a sofa) or may be used only under certain circumstances.

Larger furniture items are difficult to move out of the way if additional floor space is needed. A sofa is usually fixed in place, especially in a movable home, and cannot be moved if additional floor space is desired.

In view of the foregoing, there is a need for a furniture construction that can permit the furniture items to be easily stored within the structure.

SUMMARY OF THE INVENTION

Embodiments of the present invention aim to solve the aforementioned problems in conventional furniture.

Embodiments of the present invention provide a sofa bed assembly comprising a frame having a cushion supporting surface, the cushion supporting surface defining a frame plane intersecting a floor plane of a floor surface when the frame is in a storage configuration; and a leg rest cushion movably attached to the frame, wherein a bed configuration is formed from the frame when the frame is moved from a storage configuration into the bed configuration; the frame includes a seat back frame and a seat frame, each having a substantially planar arrangement in the bed configuration and in the storage configuration; and the seat frame movable to fold the leg rest cushion downward and to fold the seat back frame upward, converting the frame into a sofa configuration.

Embodiments of the present invention provide a sofa bed assembly comprising a seat frame supporting a seat frame cushion; a seat back frame supporting a seat back cushion; attachment members disposed on one side of the seat back frame, the attachment members pivotably connected to a fixed location of a wall; and a slider attached connecting with the seat frame, wherein the sofa bed assembly is movable between a bed configuration and a sofa configuration by horizontally sliding the slider to move the seat frame to overlap with the seat back frame while the seat back cushion is pivoted upward; and the sofa bed assembly is movable from the bed configuration to a stored configuration, with the sofa bed assembly stored against the wall, without contact with a floor surface.

Embodiments of the present invention provide a sofa bed assembly comprising a seat frame supporting a seat frame cushion; a seat back frame supporting a seat back cushion; attachment members disposed on one side of the seat back frame, the attachment members pivotably connected to a fixed location of a wall; a leg rest cushion movably attached to the seat frame; a seat frame push rod attached between the wall and the seat frame; a seat back frame push rod attached between the wall and the seat back frame; and a slider attached connecting with the seat frame, wherein the sofa bed assembly is movable between a bed configuration and a sofa configuration by horizontally sliding the slider to move the seat frame to overlap with the seat back frame while the seat back cushion is pivoted upward; the sofa bed assembly is movable from the bed configuration to a stored configuration, with the sofa bed assembly stored against the wall, without contact with a floor surface; and the leg rest cushion forms a bed surface, with the seat cushion and the seat back cushion, in the bed configuration, and the leg rest cushion is foldable to extend downward when in the sofa configuration.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
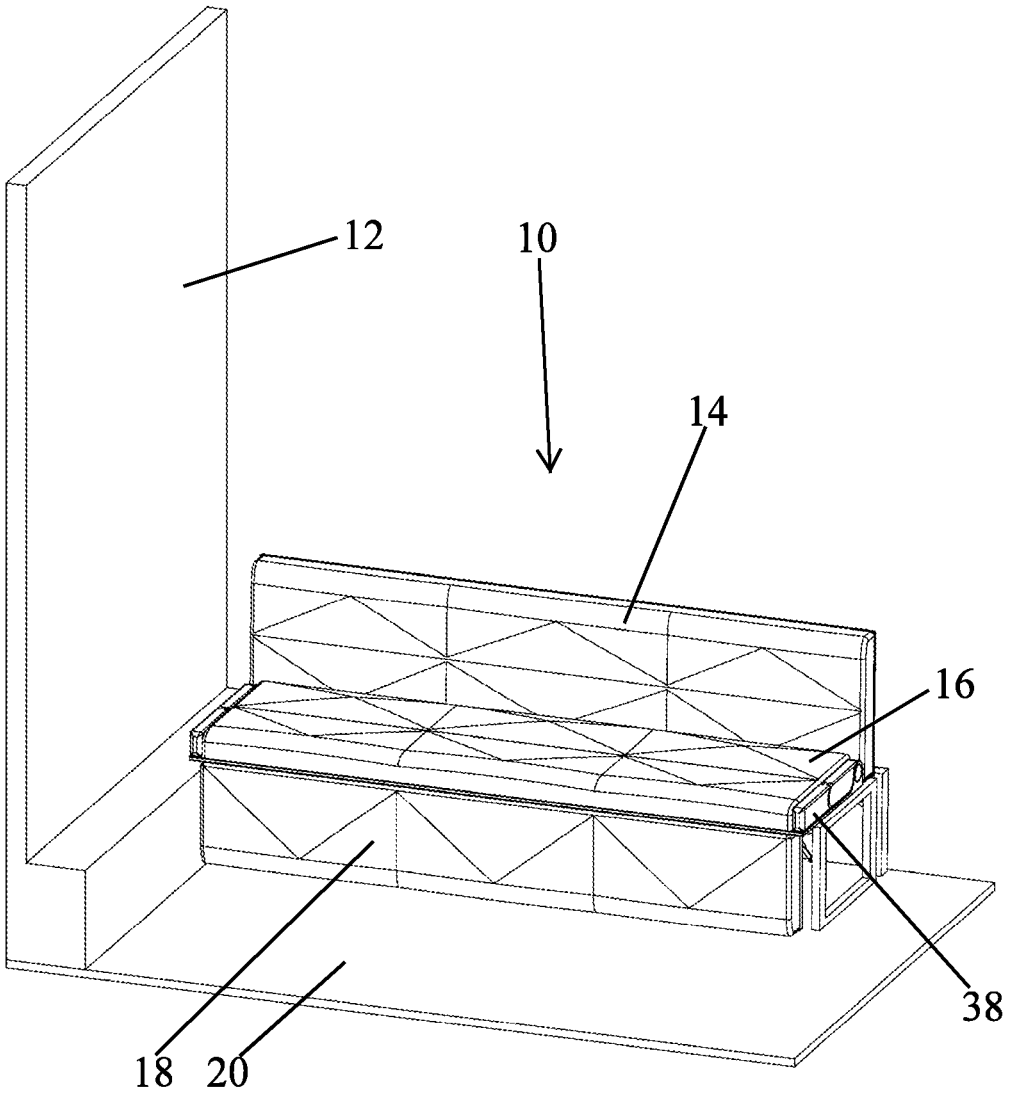
FIG. 1 illustrates a perspective view of a sofa bed in a sofa configuration, according to an exemplary embodiment of the present invention.

The illustrations in the figures may not necessarily be drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a sofa bed that can solve the problem of where to place a sofa in a smaller space or inside a recreational vehicle. The sofa can be large enough for three people to sit down, with armrests on each side and leg rests underneath. If desired, the sofa can be completely flattened out to become a sofa bed, the size of a twin size bed, for example. When not needed or when space is limited, it can be folded directly into or against the wall. The sofa bed can include three parts, the back support cushion, the seat cushion and the leg rest. The back support and seat cushions can be supported by a frame underneath. Underneath the leg rests is a system of spring-loaded rods. These three parts can be completely flattened or turned into a sofa, with the leg rests covering the frame underneath the sofa. The sofa can be folded to the wall, controlled by hydraulic rods at the bottom. There are also two sets of support legs underneath the sofa, which are equipped with counterweights at their base so that they are always perpendicular to the floor in the folded and unfolded state. The legs and the hydraulic rods can be designed to not protrude from the wall when folded.

Figure 2:
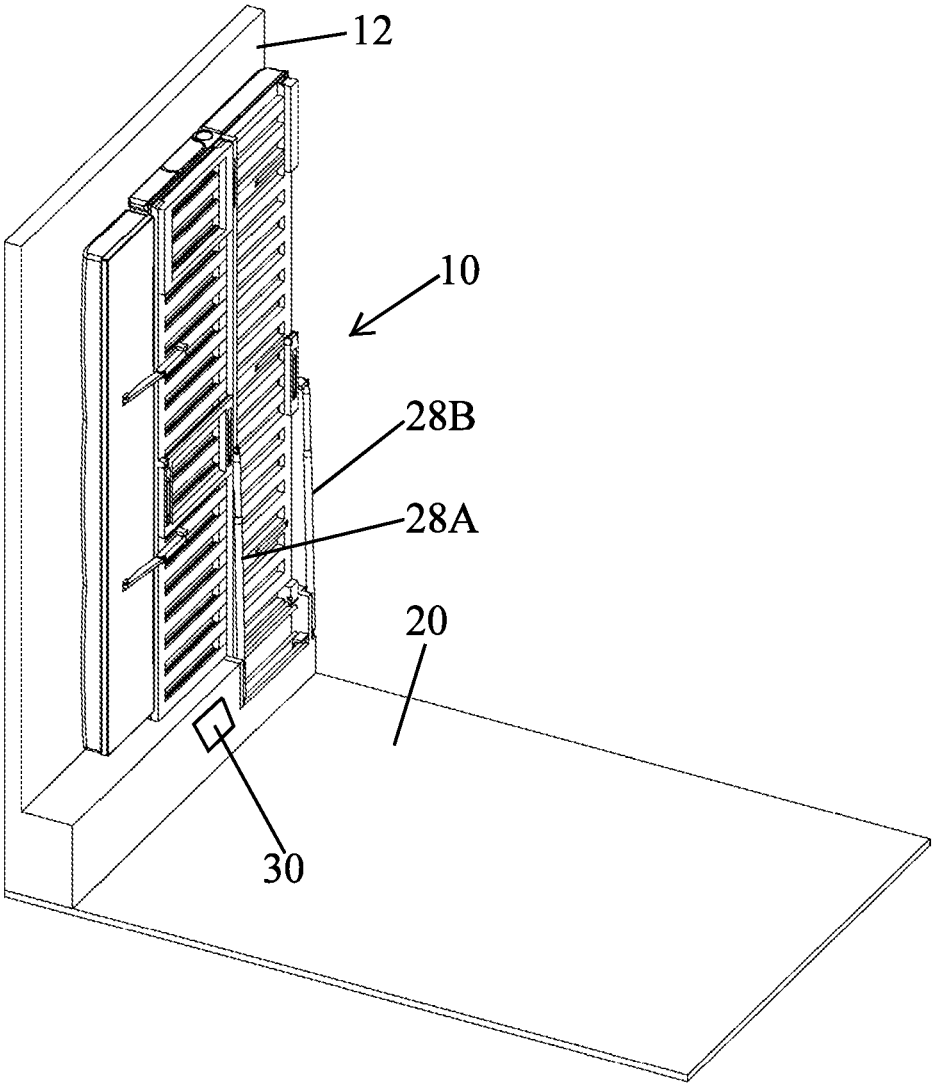
FIG. 2 illustrates a perspective view of the sofa bed of FIG. 1 in a stored configuration.
Figure 3:
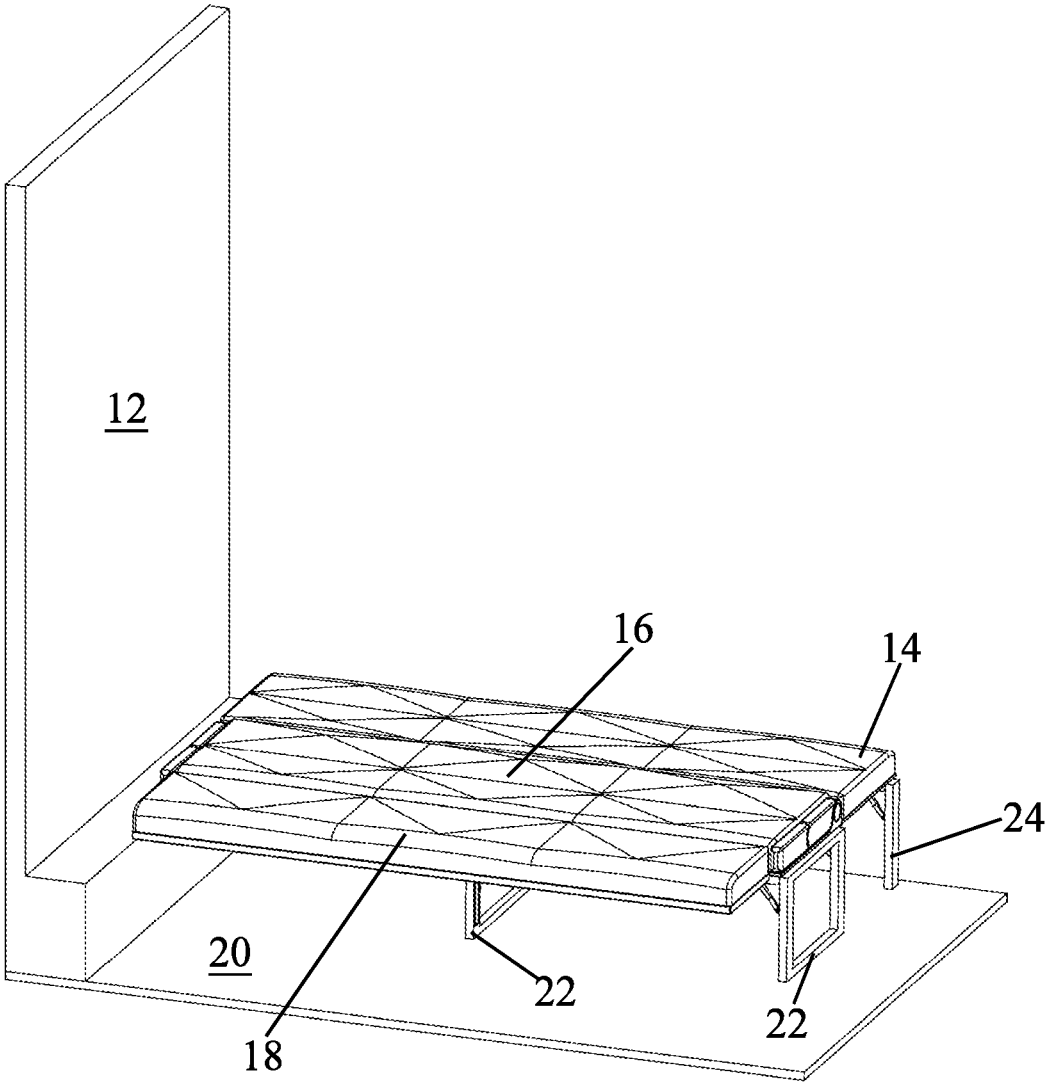
FIG. 3 illustrates a perspective view of the sofa bed of FIG. 1 in a bed configuration.

Referring to FIGS. 1 through 5, a sofa bed assembly 10 can include a seat back cushion 14, a seat cushion 16 and a leg rest cushion 18. Arm rests 38 may be disposed at opposing ends of the seat cushion 16. The sofa bed assembly 10 may be moved between a sofa configuration (FIG. 1), a stored configuration (FIG. 2) with the sofa bed assembly 10 disposed against a generally vertical wall 12, and a bed configuration (FIG. 3).

Figure 4:
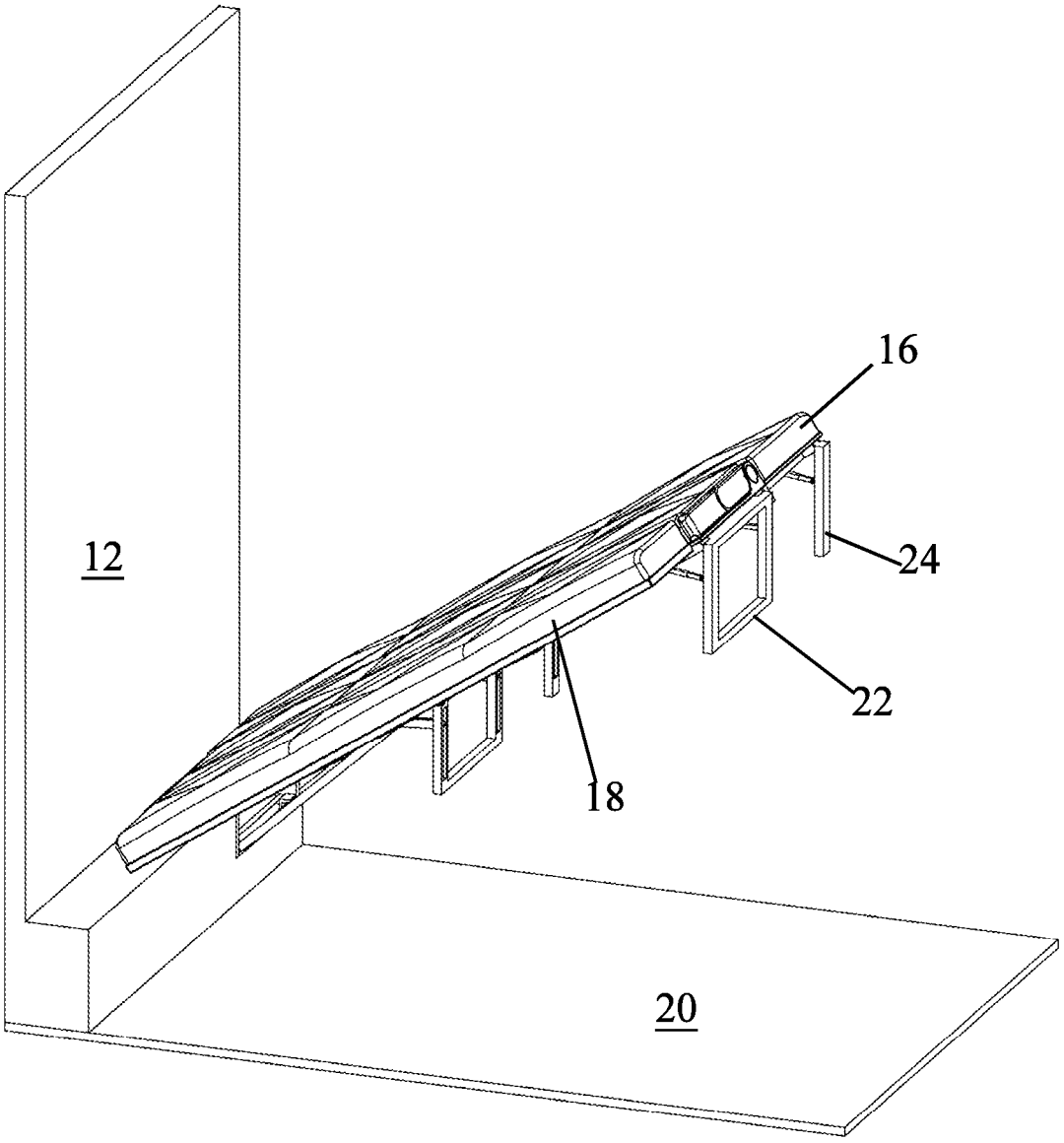
FIG. 4 illustrates a perspective view of the sofa bed of FIG. 1 being moved between the bed configuration and the stored configuration.
Figure 5:
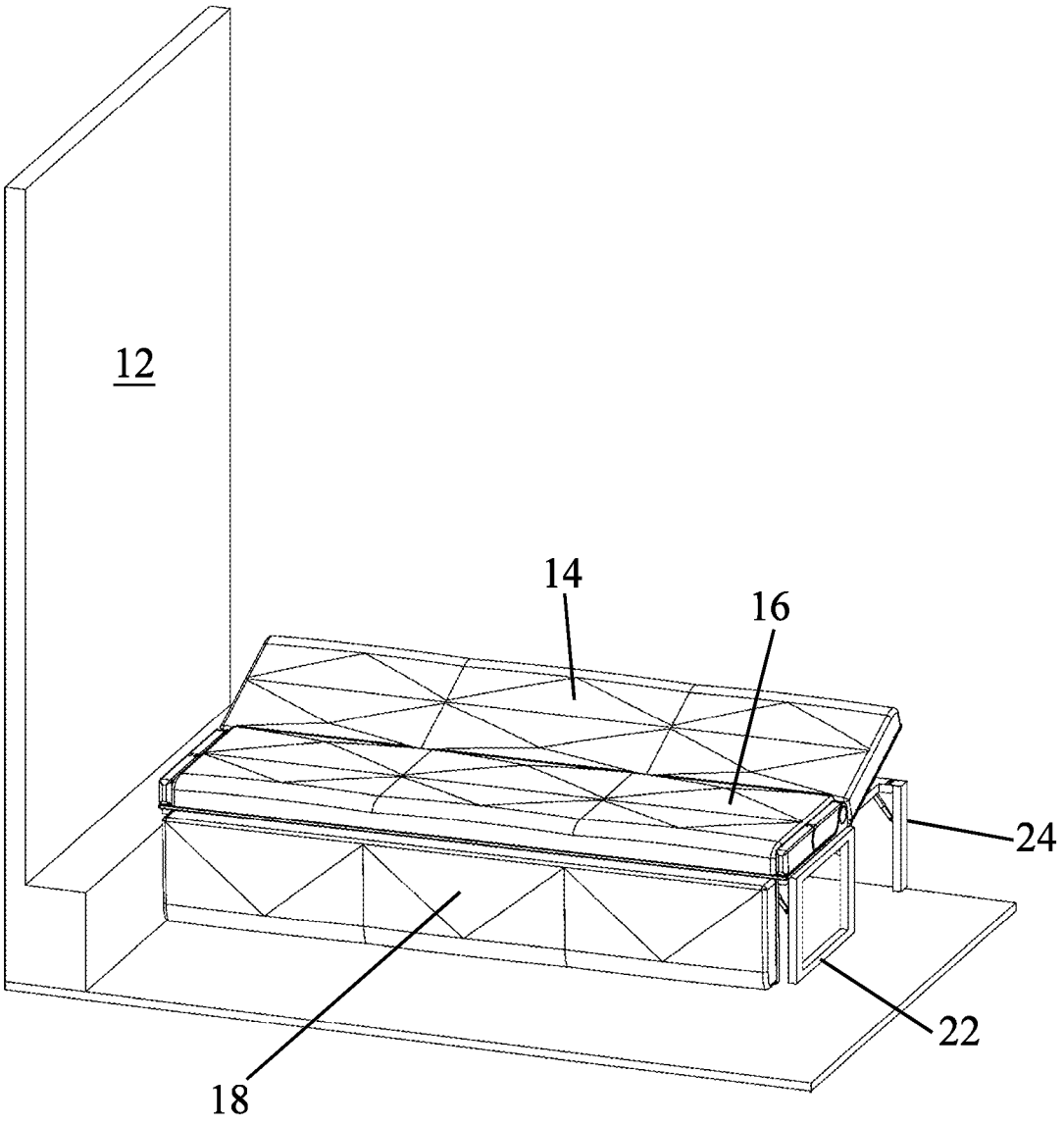
FIG. 5 illustrates a perspective view of the sofa bed of FIG. 1 being moved between the bed configuration and the stored configuration.

In the sofa configuration, seat legs 22 can support the frame 40 (see FIG. 9) of the seat cushion 16 against a floor surface 20. In the bed configuration, in addition to the seat legs 22, seat back legs 24 may help support the frame 42 (see FIG. 9) of the seat back cushion 14 against the floor surface 20. During folding from the bed configuration to the stored configuration, as best seen in FIGS. 2 and 4, the legs 22, 24 can fold so that there are no protrusions from the stored sofa bed assembly. In some embodiments, the legs 22, 24 can remain generally perpendicular to the floor surface 20 throughout all positions during movement between the sofa bed configuration and the stored configuration.

Figure 6:
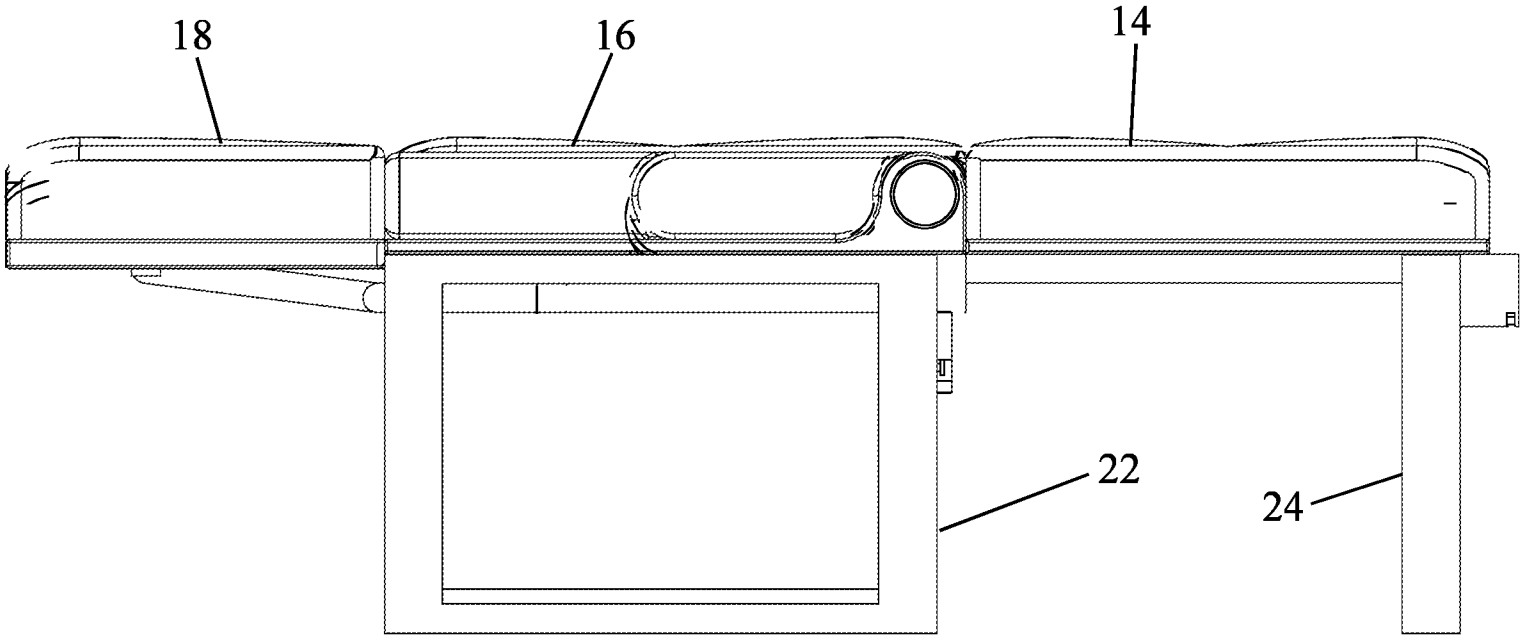
FIG. 6 illustrates a side view of the sofa bed of FIG. 1 in a bed configuration.
Figure 7:
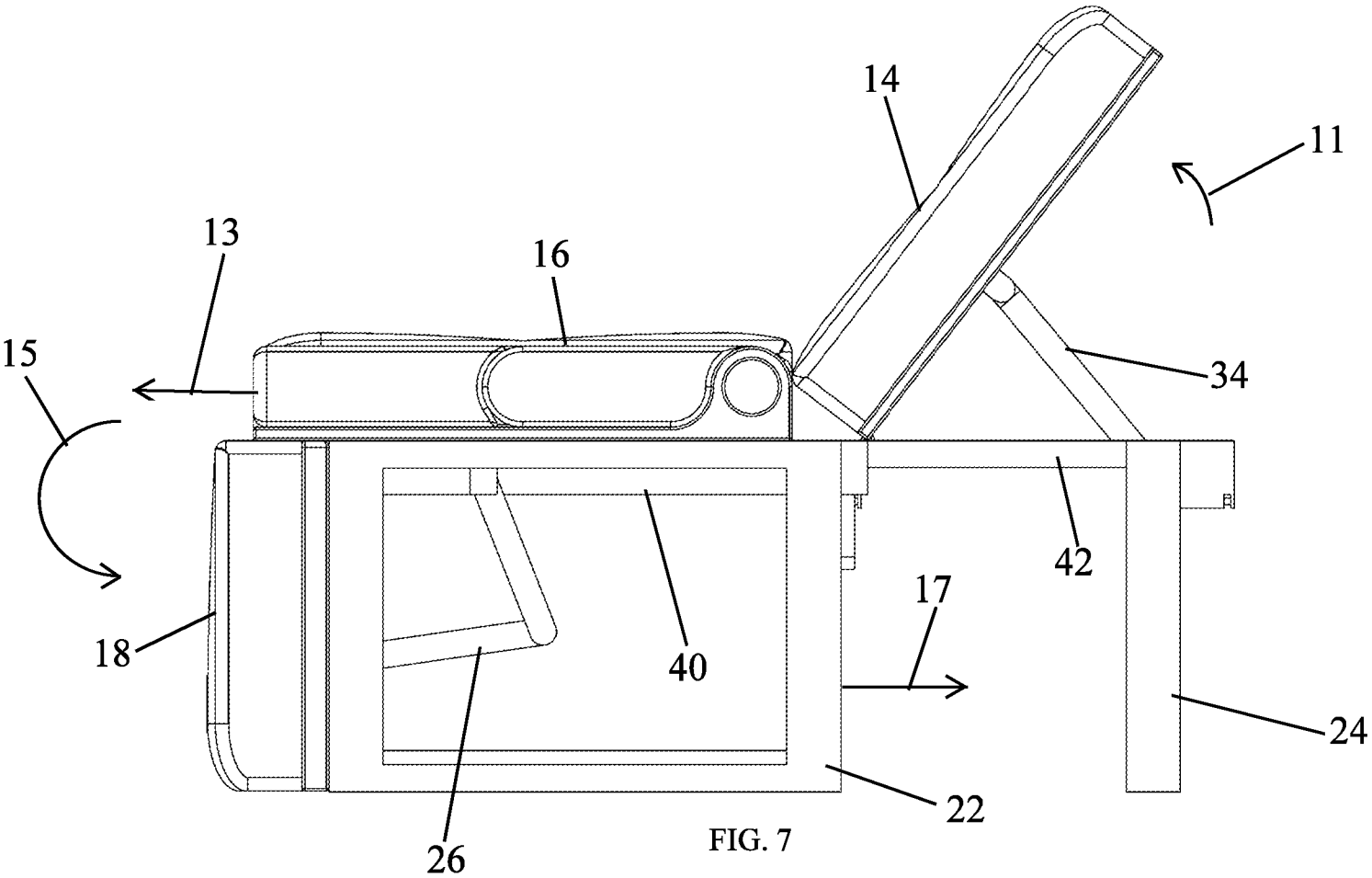
FIG. 7 illustrates a side view of the sofa bed of FIG. 1 being moved from the bed configuration toward the sofa configuration.
Figure 8:
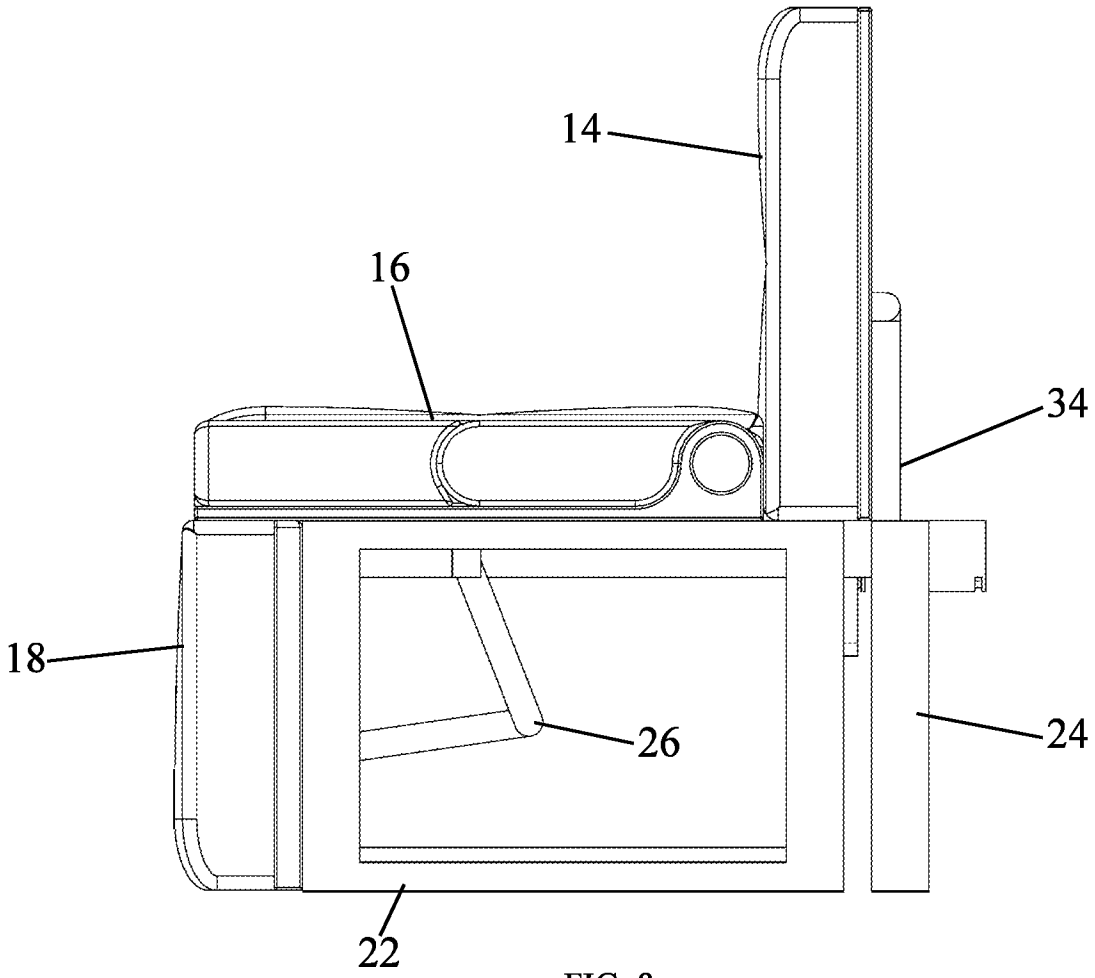
FIG. 8 illustrates a side view of the sofa bed of FIG. 1 in the sofa configuration.

Referring also now to FIGS. 6 through 8, after the sofa bed assembly 10 is lowered from the wall 12, it is in the sofa bed configuration, as shown in FIG. 6. The lowering of the assembly 10 can be controlled by a seat frame push rod 28A and a seat back push rod 28B. The push rods 28A, 28B may be hydraulic, spring loaded, or the like, to provide assistance in the transformation between the bed configuration and the stored configurations.

As can be seen, the seat back leg 24 is disposed spaced apart from the seat leg 22. To turn the sofa bed assembly 10 into the sofa configuration, as shown in FIGS. 7 and 8, a user can simply manipulate a motor 30 (shown generally by box 30 in FIG. 2, typically, the motor 30 may be disposed within the wall) to control a push block, as described in greater detail below, inside the wall to push the hydraulic rod attached to the seat frame 40, driving the whole seat frame 40 to move backward, as shown by arrow 17. As the seat frame 40 is driven backward, the seat back cushion 14 lifts as shown by arrow 11 and the seat back frame 42 meshes with the seat frame 40 (a partial mesh can be seen in FIG. 10, for example) and the seat legs 20 move adjacent the seat back legs 24, as best seen in FIG. 8.

The movement of the seat back cushion 14 upward, as shown by arrow 11, can be performed by arms 32 that connect between the seat back frame 42 and the back of the seat back cushion 14. As the seat back cushion 14 is raised, it pushes against the seat cushion 16, moving it as shown by arrow 13. The movement of the seat cushion 16 pushes down the leg rest cushion 18, as shown by arrow 15. The movement of the leg rest cushion is further guided by arms 40, which may, for example, be spring loaded or movement assisted to aid in the transformation.

In some embodiments, the cushion can attach to slots in the seat cushion frame 40 with springs pulling in the slots, which will try to keep it in its original state (not shown in the picture) and will provide movement.

Figure 9:
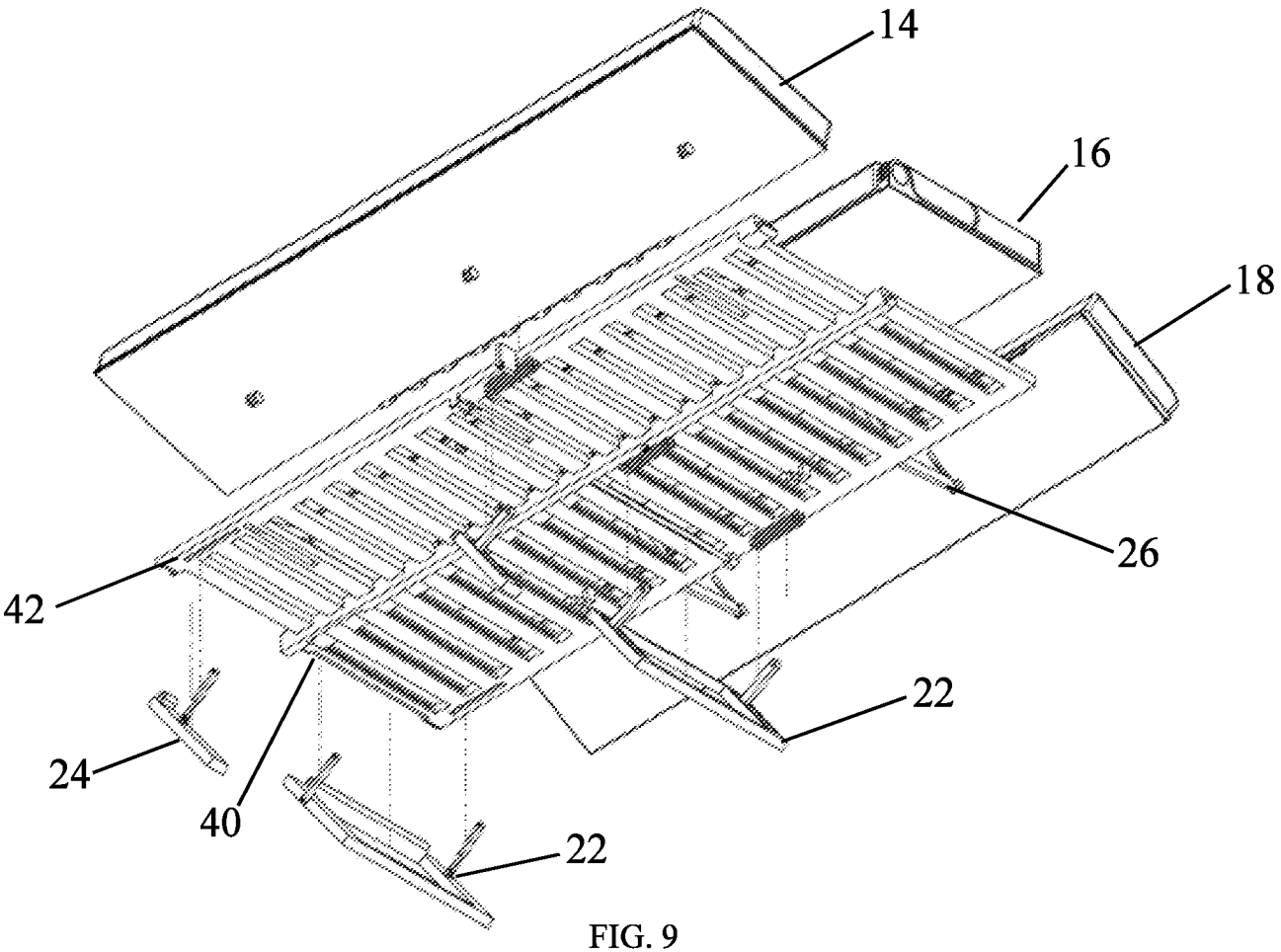
FIG. 9 illustrates an exploded, bottom perspective view of the sofa bed of FIG. 1.
Figure 10:
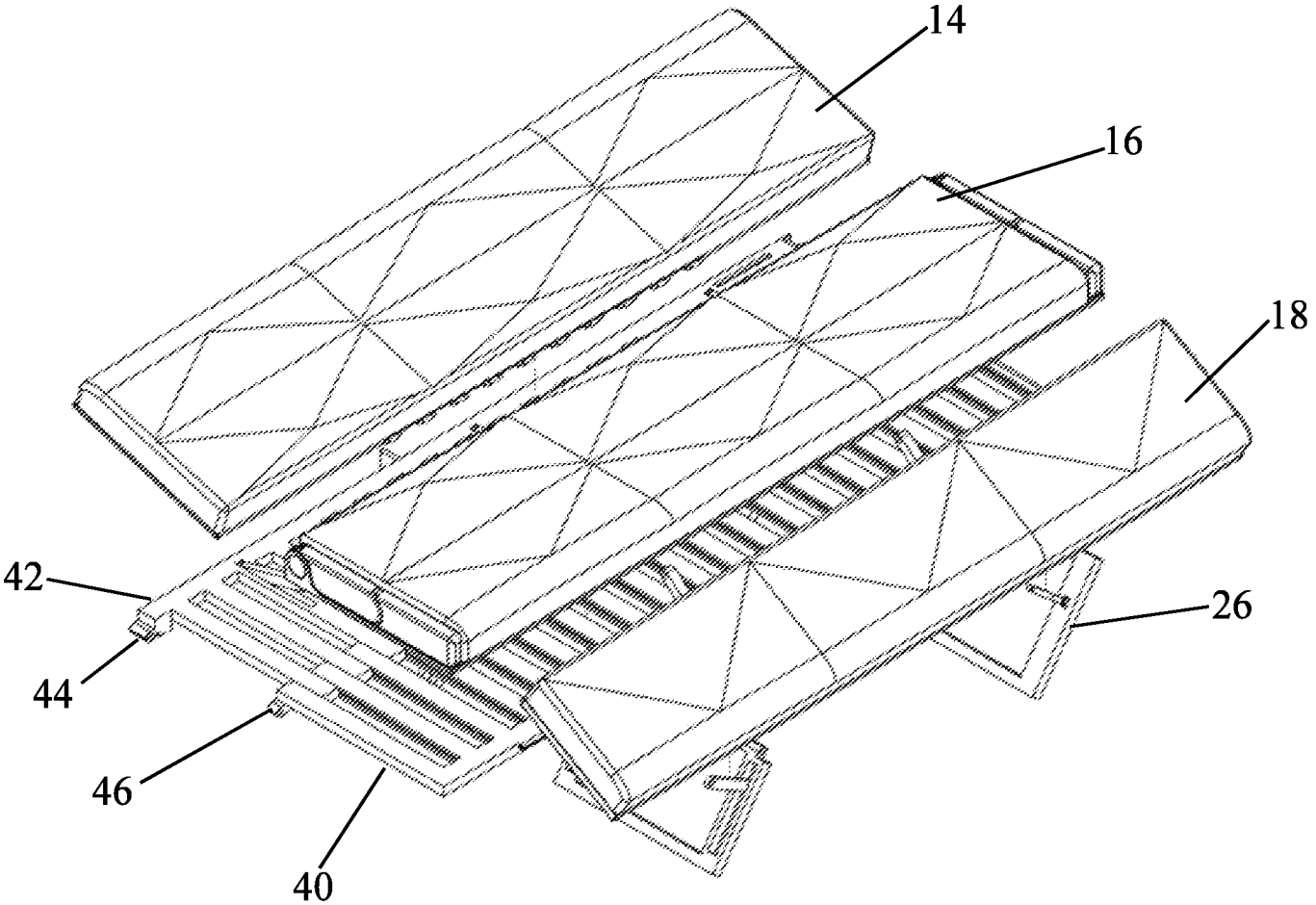
FIG. 10 illustrates an exploded, top perspective view of the sofa bed of FIG. 1.
Figure 11:
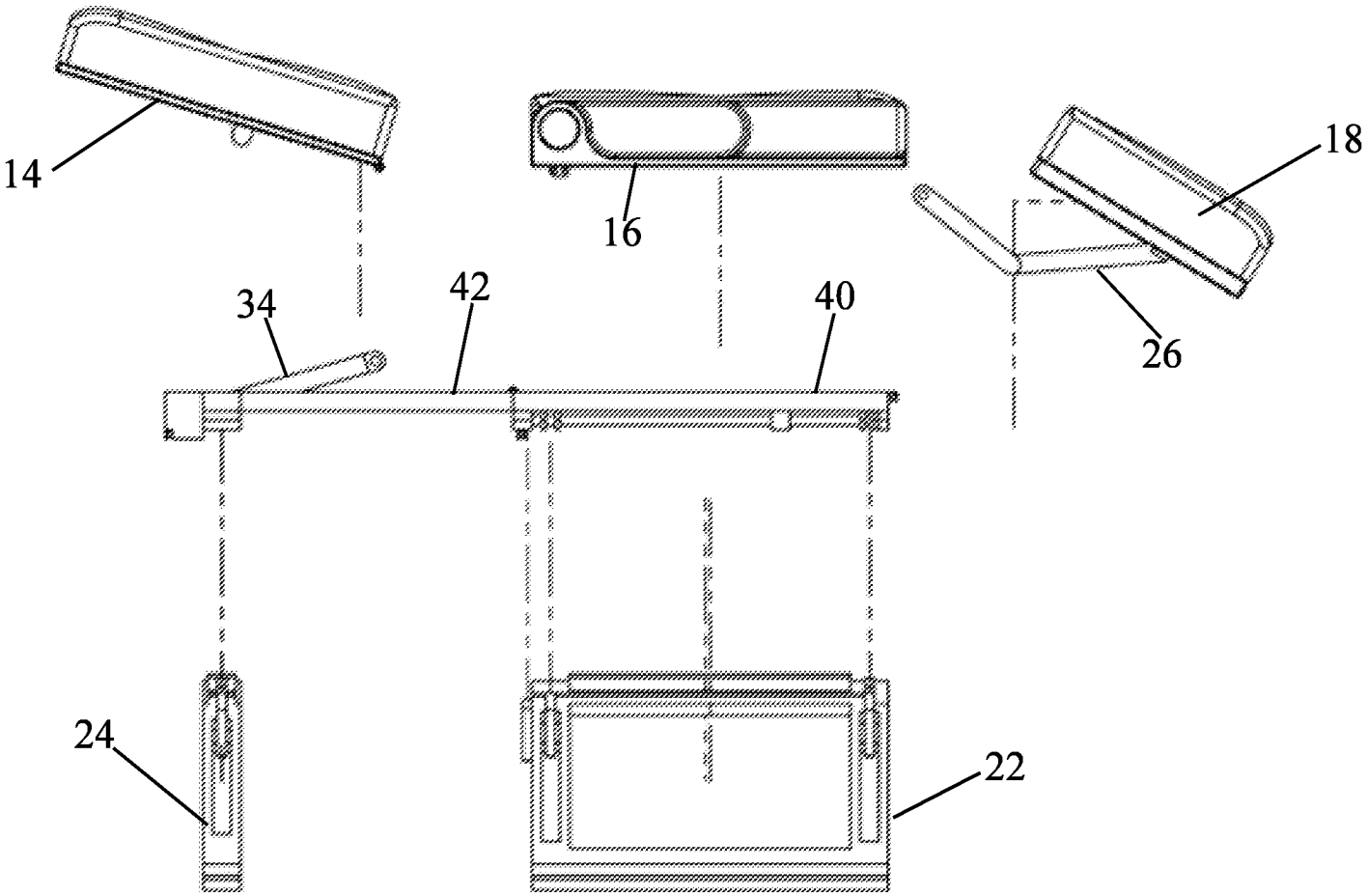
FIG. 11 illustrates an exploded side view of the sofa bed of FIG. 1.

Referring to FIGS. 9 through 11, exploded views of the assembly 10 are shown. As can be seen, the seat frame 40 can mesh with the seat back frame 42, allowing the frames to overlap when in the sofa configuration. As can be seen in FIG. 10, the seat back frame 42 can include front and rear connections 44, 46 to fix the seat back frame 42 to the wall 12 (not shown-see FIG. 1). The connections 44, 46 may be pivotably connected to the wall 12 to permit the transformations to and from the stored configuration. Thus, during transition between the bed configuration and the sofa configuration, the seat back frame 42 is fixed to the wall 12, while the seat frame 40 moves rearward, as described above.

Figure 12:
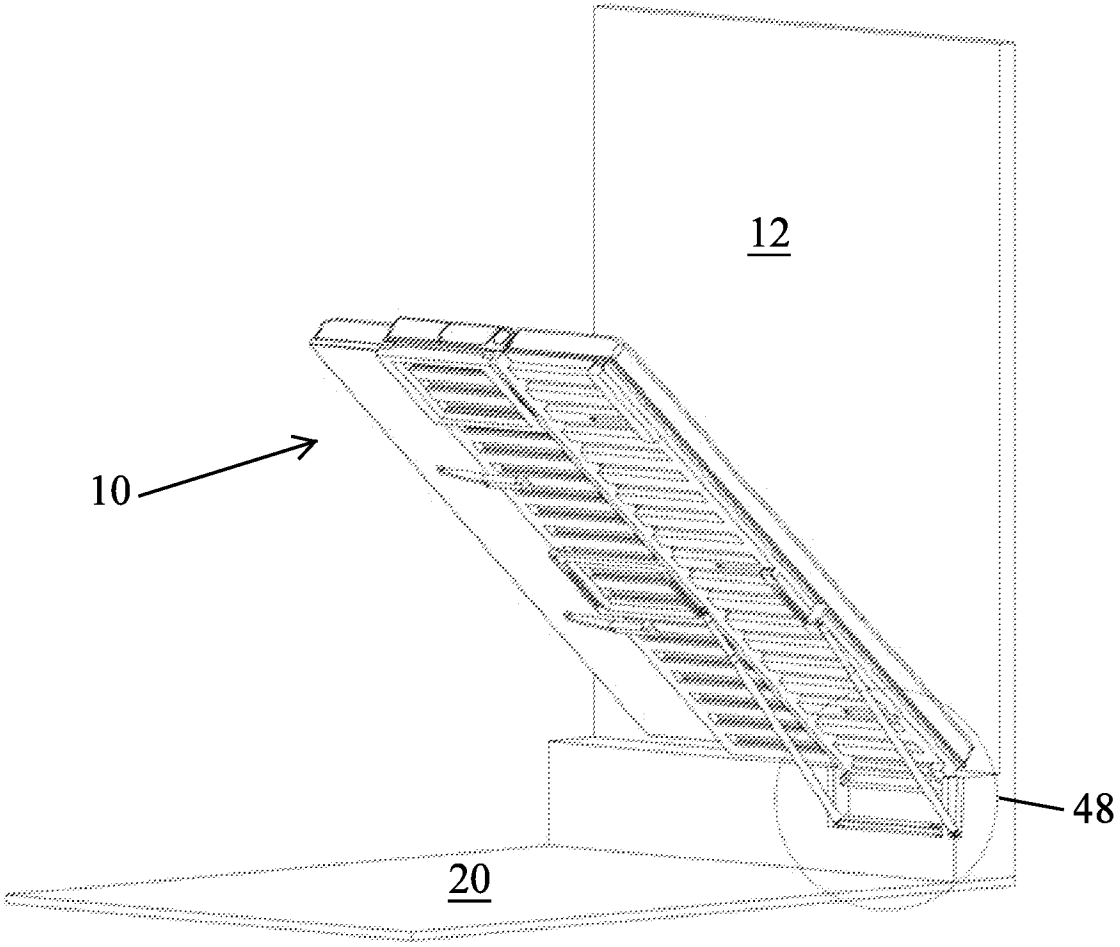
FIG. 12 illustrates a perspective view of the sofa bed of FIG. 1 between the bed configuration and the stored configuration.
Figure 13:
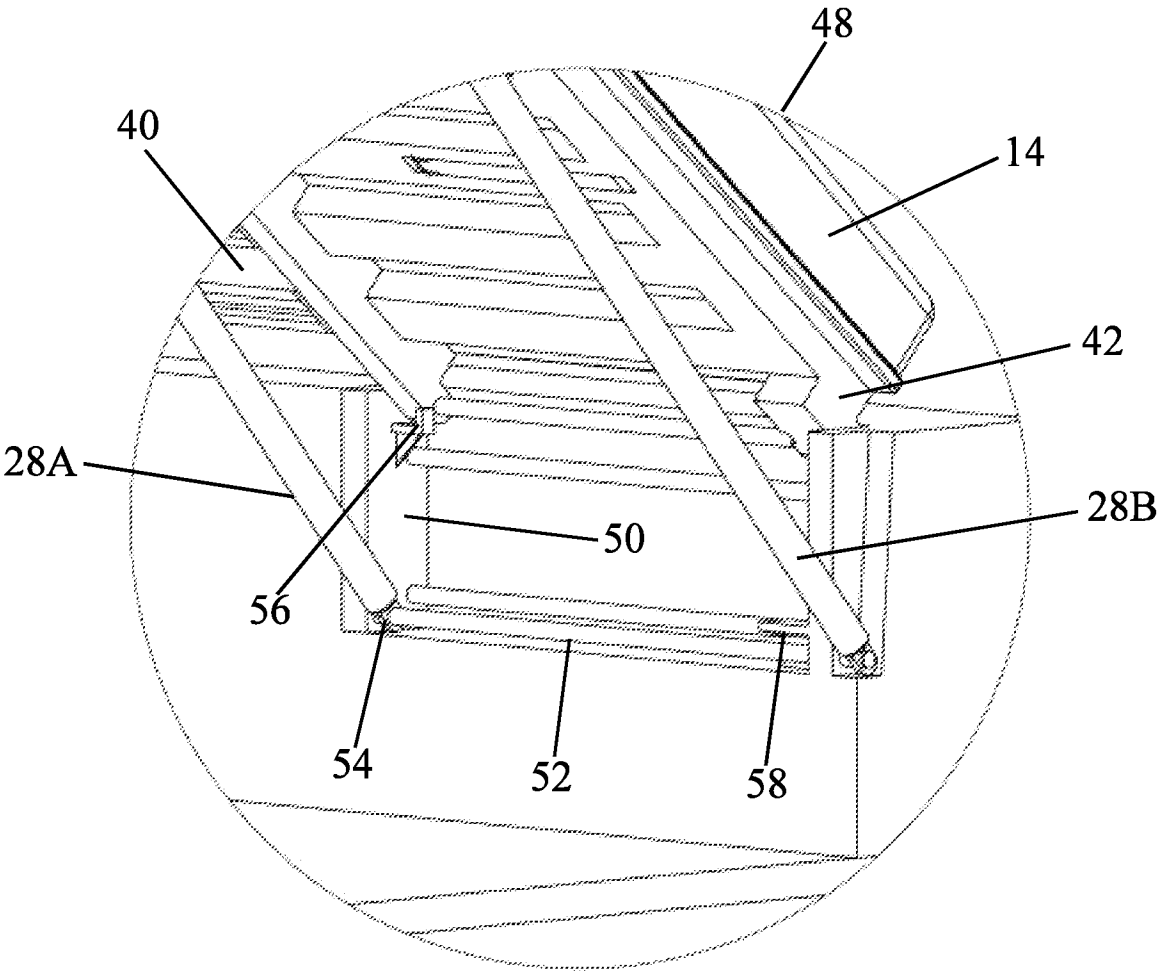
FIG. 13 illustrates a detailed view of a portion of FIG. 12.

FIG. 13 shows a detailed view taken about circle 48 of FIG. 12. As described above, the assembly 10 is controlled by two push rods 28A, 28B. One of the push rods 28B is connected to a fixed frame (the seat back frame 42) and the other push rod 28A is connected to a movable frame (the seat frame 40). After the assembly 10 has been fully lowered, the seat frame 40 can moved by a slider 50 driven by motor 30 inside the wall 12. After the assembly 10 is lowered, the seat frame 40 is placed into a slot 56 on the slider 50. After the sofa configuration has been formed, the push rod 28A attached to the seat frame 40 is geometrically limited by stopper 58. The end 54 of the push rod 28A can slide along a rail 52 during movement between the bed configuration and the sofa configuration.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A sofa bed assembly comprising:

a seat frame supporting a seat frame cushion;

a seat back frame supporting a seat back cushion;

attachment members disposed on one side of the seat back frame, the attachment members pivotably connected to a fixed location of a wall;

a leg rest cushion movably attached to the seat frame;

a seat frame push rod attached between the wall and the seat frame;

a seat back frame push rod attached between the wall and the seat back frame; and a slider attached connecting with the seat frame, wherein:

the sofa bed assembly is movable between a bed configuration and a sofa configuration by horizontally sliding the slider to move the seat frame to overlap with the seat back frame while the seat back cushion is pivoted upward;

the sofa bed assembly is movable from the bed configuration to a stored configuration, with the sofa bed assembly stored against the wall, without contact with a floor surface; and the leg rest cushion forms a bed surface, with the seat cushion and the seat back cushion, in the bed configuration, and the leg rest cushion is foldable to extend downward when in the sofa configuration.

2. The sofa bed assembly of claim 1, further comprising:

seat frame legs supporting the seat frame when the sofa bed assembly is in the sofa configuration and in the bed configuration; and seat back frame legs supporting the seat back frame when the sofa bed assembly is in the bed configuration, wherein in the bed configuration, the seat frame legs are spaced a first distance apart from the seat back frame legs and, in the sofa configuration, the seat frame legs are spaced a second distance, shorter than the first distance, apart from the seat back frame legs.

3. A sofa bed assembly, comprising:

a frame having a cushion supporting surface, the cushion supporting surface defining a frame plane intersecting a floor plane of a floor surface when the frame is in a storage configuration; and a leg rest cushion movably attached to the frame, wherein:

a bed configuration is formed from the frame when the frame is moved from a storage configuration into the bed configuration;

the frame includes a seat back frame and a seat frame, each having a substantially planar arrangement in the bed configuration and in the storage configuration; and the seat frame is movable to fold the leg rest cushion downward and to fold the seat back frame upward, converting the frame into a sofa configuration.

4. The sofa bed assembly of claim 3, further comprising:

a seat frame push rod attached between the wall and the seat frame; and a seat back frame push rod attached between the wall and the seat back frame.

5. The sofa bed assembly of claim 4, further comprising a stopper, the stopper engaging with the seat frame push rod when in the sofa configuration to restrict movement of the seat frame push rod and to prevent inadvertent movement of the sofa bed assembly directly from the sofa configuration to the stored configuration.

6. The sofa bed assembly of claim 3, further comprising:

seat frame legs supporting the seat frame when the sofa bed assembly is in the sofa configuration and in the bed configuration; and seat back frame legs supporting the seat back frame when the sofa bed assembly is in the bed configuration.

7. The sofa bed assembly of claim 6, wherein, in the bed configuration, the seat frame legs are spaced a first distance apart from the seat back frame legs and, in the sofa configuration, the seat frame legs are spaced a second distance, shorter than the first distance, apart from the seat back frame legs.

8. The sofa bed assembly of claim 6, wherein the seat frame legs and the seat back legs are substantially perpendicular to the floor plane during transition between the stored configuration and the bed configuration.

9. The sofa bed assembly of claim 3, further comprising a slider operable to push the seat frame rearward to overlap with the seat back frame during transition from the bed configuration to the sofa configuration.

10. The sofa bed assembly of claim 9, wherein the slider is driven by a motor.

11. The sofa bed assembly of claim 3, wherein the seat back frame is fixed to the wall.

12. The sofa bed assembly of claim 3, further comprising:

a seat cushion attached to the seat frame; and a seat back cushion attached to the seat back frame.

13. The sofa bed assembly of claim 12, further comprising an arm pivotably connecting the seat back cushion to the seat back frame, the arm supporting the seat back cushion in the sofa configuration.

14. The sofa bed assembly of claim 12, further comprising leg rest arms attached between the leg rest and the seat frame, the leg rest arms permitting the leg rest to move from the bed configuration, where the leg rest is substantially planar with the seat back cushion and the seat cushion, to the sofa configuration, where the leg rest extends downward from the seat frame.

15. A sofa bed assembly comprising:

a seat frame supporting a seat frame cushion;

a seat back frame supporting a seat back cushion;

attachment members disposed on one side of the seat back frame, the attachment members pivotably connected to a fixed location of a wall;

a leg rest cushion movably attached to the seat frame, wherein the leg rest cushion forms a bed surface, with the seat cushion and the seat back cushion, in the bed configuration, and the leg rest cushion is foldable to extend downward when in the sofa configuration;

a slider attached connecting with the seat frame, wherein:

the sofa bed assembly is movable between a bed configuration and a sofa configuration by horizontally sliding the slider to move the seat frame to overlap with the seat back frame while the seat back cushion is pivoted upward; and the sofa bed assembly is movable from the bed configuration to a stored configuration, with the sofa bed assembly stored against the wall, without contact with a floor surface.

16. The sofa bed assembly of claim 15, further comprising:

seat frame legs supporting the seat frame when the sofa bed assembly is in the sofa configuration and in the bed configuration; and seat back frame legs supporting the seat back frame when the sofa bed assembly is in the bed configuration, wherein in the bed configuration, the seat frame legs are spaced a first distance apart from the seat back frame legs and, in the sofa configuration, the seat frame legs are spaced a second distance, shorter than the first distance, apart from the seat back frame legs.

17. The sofa bed assembly of claim 15, wherein the slider is driven by a motor.

18. The sofa bed assembly of claim 15, further comprising an arm pivotably connecting the seat back cushion to the seat back frame, the arm supporting the seat back cushion in the sofa configuration.

19. The sofa bed assembly of claim 15, further comprising:

a seat frame push rod attached between the wall and the seat frame; and a seat back frame push rod attached between the wall and the seat back frame.

* * * * *